US007387683B2

(12) United States Patent
Kim et al.

(10) Patent No.: US 7,387,683 B2
(45) Date of Patent: Jun. 17, 2008

(54) DISCHARGING UNIT FOR DISCHARGING A PHOTOSENSITIVE MATERIAL, COATER HAVING THE DISCHARGING UNIT, AND APPARATUS FOR COATING A PHOTOSENSITIVE MATERIAL HAVING THE COATER

(76) Inventors: Seong-Bong Kim, 113-1405 Geukdong Neulpureun Apt., Dujeong-dong, Cheonan-si, Chungcheongnam-do (KR); Dong-Uk Choi, 311-2002 Cheongmyeongmaeul 3danji Dongsin Apt., Youngtong-dong, Paldal-gu, Suwon-si, Gyeonggi-do (KR)

( * ) Notice: Subject to any disclaimer, the term of this patent is extended or adjusted under 35 U.S.C. 154(b) by 470 days.

(21) Appl. No.: 10/790,081

(22) Filed: Mar. 2, 2004

(65) Prior Publication Data

US 2004/0173148 A1 Sep. 9, 2004

(30) Foreign Application Priority Data

Mar. 6, 2003 (KR) ..... 10-2003-0014016
Mar. 11, 2003 (KR) ..... 10-2003-0015009

(51) Int. Cl.
*B05C 11/00* (2006.01)

(52) U.S. Cl. ..... 118/670; 118/712

(58) Field of Classification Search ..... 118/411, 118/410, 670, 712, 668, 679, 686, 314, 315, 118/323, 324
See application file for complete search history.

(56) References Cited

U.S. PATENT DOCUMENTS

| | | | | |
|---|---|---|---|---|
| 3,753,085 | A * | 8/1973 | Morton et al. | 324/226 |
| 3,924,565 | A * | 12/1975 | Benner et al. | 118/323 |
| 5,334,247 | A * | 8/1994 | Columbus et al. | 118/411 |
| 5,575,852 | A * | 11/1996 | Chase | 118/680 |
| 5,683,037 | A * | 11/1997 | Rochman et al. | 239/536 |
| 6,013,308 | A * | 1/2000 | Saito | 427/8 |
| 6,398,870 | B1 * | 6/2002 | Kaya et al. | 118/323 |
| 6,695,923 | B1 * | 2/2004 | Schultz et al. | 118/679 |
| 2003/0131791 | A1 * | 7/2003 | Schultz et al. | 118/324 |

* cited by examiner

*Primary Examiner*—Brenda A. Lamb

(57) ABSTRACT

A coating apparatus includes support for supporting a mother substrate including unit substrates, a coater for coating the unit substrate with photosensitive materials, a detector for detecting foreign matters, a remover for removing the foreign matters from the unit substrate, and a controller for controlling the coater, detector, and remover. The coater includes a body containing the photosensitive materials, and inlet and outlet portions for inputting and outputting the photosensitive materials to/from the body. A width of the outlet portion is the same as that of the unit substrate. The detector is positioned at front of the coater to detect the foreign matters before the coating process. The remover removes the foreign matters. The coater discharges the photosensitive material only onto the unit substrate. Discharging of the photosensitive material is interrupted when the foreign matters are found. The coating apparatus requires less photosensitive material, and can be more efficient

13 Claims, 13 Drawing Sheets

DISCHARGING UNIT FOR DISCHARGING A PHOTOSENSITIVE MATERIAL, COATER HAVING THE DISCHARGING UNIT, AND APPARATUS FOR COATING A PHOTOSENSITIVE MATERIAL HAVING THE COATER

CROSS-REFERENCE OF RELATED APPLICATIONS

This application claims priority under 35 USC § 119 to Korean Patent Application No. 2003-14016 filed on Mar. 6, 2003 and Korean Patent Application No. 2003-15009 filed on Mar. 11, 2003, the contents of which are herein incorporated by reference in their entireties.

BACKGROUND OF THE INVENTION (a) Field of the Invention

The present invention relates to a discharging unit, a coater having the discharging unit, and an apparatus for coating the photosensitive material. More particularly, the present invention relates to a discharging unit for discharging a photosensitive material, a coater including the discharging unit, and an apparatus for coating a photosensitive material using the coater, so that foreign matters are efficiently removed from a target wafer and the photosensitive material is selectively coated on the target wafer.

(b) Description of the Related Art

A photosensitive material, which may be chemically reactive to light, is now widely used for a predetermined patterning of various kinds of thin films, such as oxide thin film, metal thin film, or semiconductor thin film, etc., so that the films perform a predetermined function thereof.

The photosensitive material, generally, requires a uniform thickness on the thin film to prevent processing failures. For example, when the photosensitive material is over-coated on the thin film, the photosensitive material on a portion of the thin film to be patterned is not completely removed, so that the thin film is insufficiently etched away during an etching process. In contrast, when the photosensitive material is not sufficiently coated on the thin film, the thin film is over-etched away since the thin film may be removed when the photosensitive material on a portion of the thin film to be patterned is partially removed. That is, when the photosensitive material is non-uniformly coated on a whole surface of the substrate, the thin film under the photosensitive material may be over-etched or under etched, finally causing process failures.

Generally, the photosensitive material is coated on the thin film by a spin coating process. When the photosensitive material is dropped on the substrate spinning with a high angular speed, the centrifugal force renders the dropped photosensitive material to spread in uniform thickness on the whole surface of the substrate, thus the photosensitive material is uniformly coated on the substrate.

However, even though the photosensitive material is not uniformly coated on a light and small substrate such as a wafer for manufacturing semiconductor devices, the spin coating process is disadvantageous to a heavy and broad substrate such as a liquid crystal panel. The broader and heavier the substrate is, the lower the angular speed is, and thus the photosensitive material is not uniformly coated on the substrate. In addition, when the angular speed of the liquid crystal panel is increased for improving coating uniformity, a corner portion of the substrate may be broken by the centrifugal force proportional to the angular speed sq. thereof, and the power for driving the substrate is inefficiently consumed.

A slit coating process is widely used for preventing the above-mentioned problems. According to the slit coating process, the photosensitive material is injected onto the substrate through the slit-shaped coater having a length much greater than a width thereof, and the photosensitive material is coated on the substrate by repeatedly moving the coater along a longitudinal or a latitudinal line of the substrate. The coater includes a body, an inlet potion, and an outlet potion. A containing space for containing the photosensitive material is formed in the body, and the inlet potion is formed at first side portion of the body. The outlet portion is formed into a slit shape, having a length much more than a width thereof, at a second side portion of the body facing the substrate.

However, the slit coating process has a problem that a marginal photosensitive material needs to be removed after completing the coating process in manufacturing an LCD device. The length of the outlet is similar to the width of a mother substrate, and the photosensitive material is coated on a whole surface of the mother substrate at a time. Meanwhile, the mother substrate is divided into a plurality of unit substrates, and in the end, the unit substrate is separated from the mother substrate. Each of the unit substrate is formed into the liquid crystal panel such as a thin film transistor (TFT) substrate and a color filter (C/F) substrate, respectively. A thin film for forming the TFT substrate or the C/F substrate is individually coated on each unit substrate. Therefore, the marginal photosensitive material, which is coated on a marginal region of the unit substrate on the mother substrate, needs to be removed, since the marginal photosensitive material is not necessary for forming the liquid crystal panel.

Therefore, the slit coating process is disadvantageous in that the processing time for the coating process is increased and the expensive photosensitive material is wasted. In addition, foreign matters floating in the air may easily stick to the mother substrate since the mother substrate does not rotate any longer, so that some voluminous foreign matters usually collide with the coater. That is, the foreign matters may easily cause damage a portion of the coater. Furthermore, the foreign matters move along the surface of the mother substrate together with the coater, thereby causing scratch on the surface of the mother substrate.

SUMMARY OF THE INVENTION

Accordingly, the present invention is directed to introduce an apparatus for coating the substrate that substantially obviates one or more problems due to the limitations and disadvantages of the related art.

The present invention provides a discharging unit for discharging a photosensitive material to a substrate.

The present invention also provides a coater including the discharging unit for coating the photosensitive layer only on the unit substrate divided on the mother substrate.

Further, the present invention provides an apparatus for coating a photosensitive layer on a substrate by the unit substrate divided on the substrate.

According to an exemplary embodiment of the present invention, a discharging unit for discharging a photosensitive material comprises a body having a first face facing a substrate, at least an inlet portion disposed on a portion of the body, and at least an outlet portion disposed on the first face of the body. The substrate includes a plurality of coating areas on which a photosensitive material is coated. The photosensitive material is provided into the body through the inlet portion, and the outlet portion renders the photosensitive material to discharge onto the coating area.

According to another exemplary embodiment of the present invention, a discharging unit for discharging a photosensitive material comprises a plurality of bodies, an inlet portion disposed on a portion of each of the bodies, and an outlet portion disposed on the first face of each of the bodies, and at least a spacer for combining the bodies with each other. The substrate includes a plurality of coating areas on which a photosensitive material is coated. The photosensitive material is individually provided into each of the bodies through the inlet portion, and the outlet portion renders the photosensitive material to discharge onto the coating area. The plurality of the bodies operates together with each other by the spacer block.

According to still another exemplary embodiment of the present invention, a coater for coating a photosensitive layer comprises a supporting unit for supporting a mother substrate, a discharging unit for discharging the photosensitive material on the substrate, a supplying unit for supplying the photosensitive material to the discharging unit, and a transferring unit for moving the discharging unit relative to the supporting unit. The mother substrate has a plurality of unit substrates on which the photosensitive material is coated. The discharging unit includes a plurality of bodies, an inlet portion disposed on a portion of each body, an outlet portion disposed on a first face of the each body, a combining part for combining the bodies with each other. Each of the bodies has a first face facing the mother substrate. The photosensitive material is provided into the body through the inlet portion, and is discharged onto the unit substrate through the outlet portion. The plurality of the bodies operates together with each other.

According to further still another exemplary embodiment of the present invention, a coater for coating a photosensitive layer comprises a supporting unit for supporting a mother substrate, a discharging unit for discharging the photosensitive material on the substrate, a supplying unit for supplying the photosensitive material to the discharging unit, and a transferring unit for moving the discharging unit relative to the support. The mother substrate has a plurality of unit substrates on which the photosensitive material is coated. The discharging unit includes a body, an inlet portion disposed on a portion of the body, an outlet portion disposed on a first face of the body. The body has a first face facing the mother substrate. The photosensitive material is provided into the body through the inlet portion, and is discharged onto the unit substrate through the outlet portion.

According to further still another exemplary embodiment of the present invention, an apparatus for coating a photosensitive layer on a substrate comprises a support for supporting a substrate, a coater for coating the photosensitive layer on the substrate, a detector for detecting foreign matters on the substrate, a remover for removing the foreign matters from the substrate, and a controller for controlling the coater, the detector and the remover. The substrate has a plurality of unit substrates on which the photosensitive material is coated. The coater moves along a surface of the substrate by a transfer unit, and discharges the photosensitive material onto the unit substrate, for thereby coating the photosensitive layer on the substrate by the unit substrate. The detector is disposed in front of the coater. As an exemplary embodiment, an inspector may be installed in rear of the coater so as to inspect a surface of the photosensitive layer on the substrate.

With the above exemplary embodiments, the photosensitive material can be coated on the unit substrate of the mother substrate and not on the mother substrate, so that the photosensitive material is prevented from being wasted and the processing time is reduced. In addition, foreign matters are removed from the surface of the mother substrate before the photosensitive material is coated, so that process failure and substrate fracture due to the foreign matters can be prevented.

BRIEF DESCRIPTION OF THE DRAWINGS

The above and other objects and advantages of the present invention will become readily apparent by reference to the following detailed description when considered in conjunction with the accompanying drawings, in which.

DESCRIPTION OF EXEMPLARY EMBODIMENTS

The present invention now will be described more fully hereinafter with reference to the accompanying drawings, in which exemplary embodiments of the present invention are is shown. This invention may, however, be embodied in many different forms and should not be construed as limited to the embodiments set forth herein. As an exemplary embodiment, the present invention discloses a coater for coating the photosensitive layer on the unit substrate of the mother substrate for manufacturing a liquid crystal display (LCD) device. However, the spirit and scope of the present invention should not be limited to the coater for manufacturing the LCD device, as would be known to a person having ordinary skill in the art.

Figure 1:
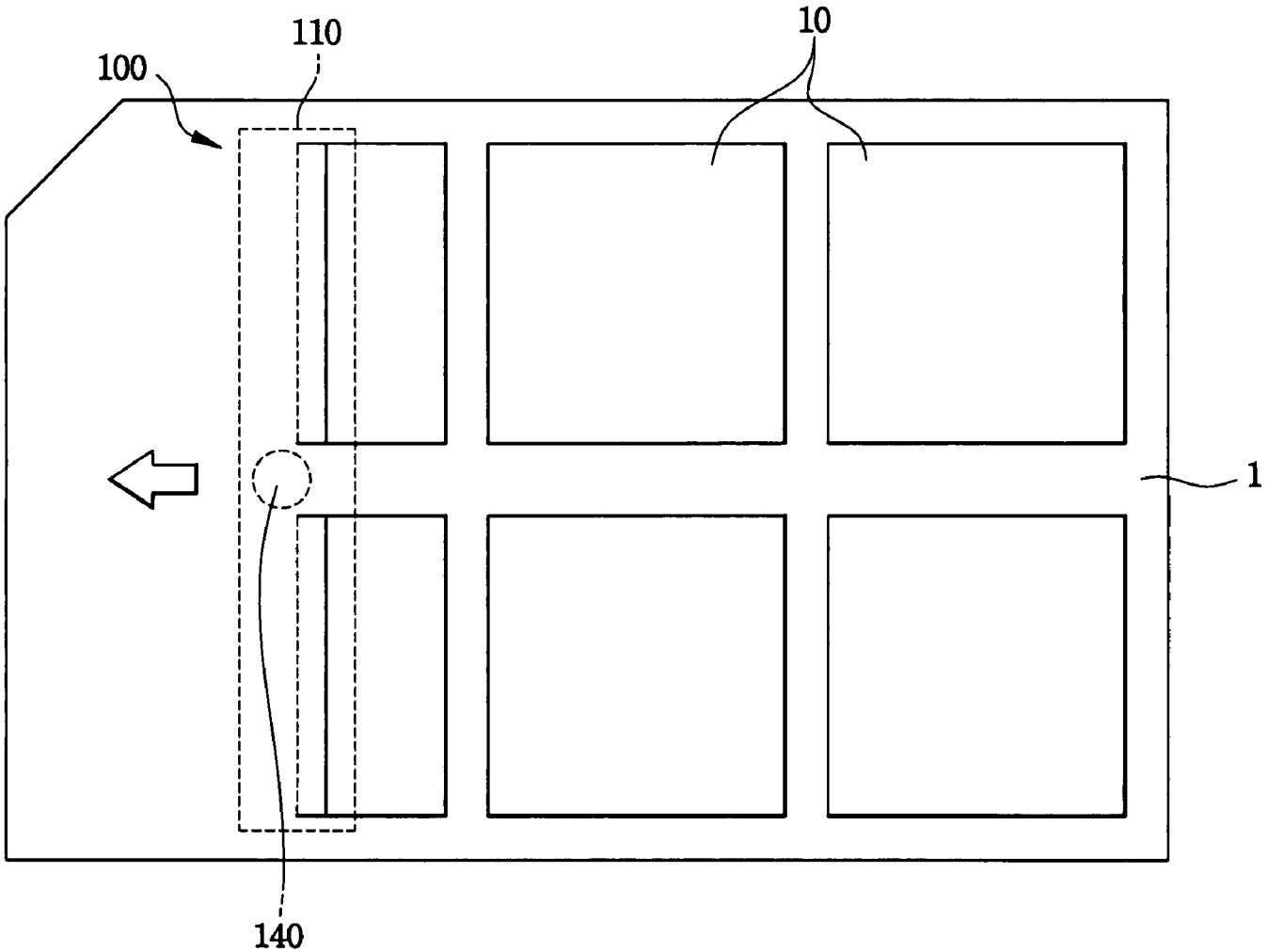
FIG. 1 is a schematic view showing a discharging unit for discharging a photosensitive material according to an exemplary embodiment of the present invention.

FIG. 1 is a schematic view showing a discharging unit for discharging a photosensitive material according to an exemplary embodiment of the present invention.

Referring to FIG. 1, the discharging unit 100 includes a body 110 and an inlet portion 140. The body 110 includes a containing space for containing the photosensitive material therein, and discharges the photosensitive material onto surfaces of each unit substrate 10 in the mother substrate 1. A plurality of unit substrates 10 is spaced apart from each other on the mother substrate 1, and is formed in a matrix shape. Each of the unit substrate 10 is cut off from the mother substrate 1, thereby being formed into a thin film transistor (TFT) or a color filter (C/F) substrate according to a kind of the thin film coated thereon. The photosensitive material is provided into the containing space in the body 110 through the inlet portion 140.

Hereinafter, exemplary embodiments of the discharging unit and a coater including the discharging unit are described in detail.

Exemplary Embodiments on the Discharging Unit

Embodiment 1

Figure 2A:
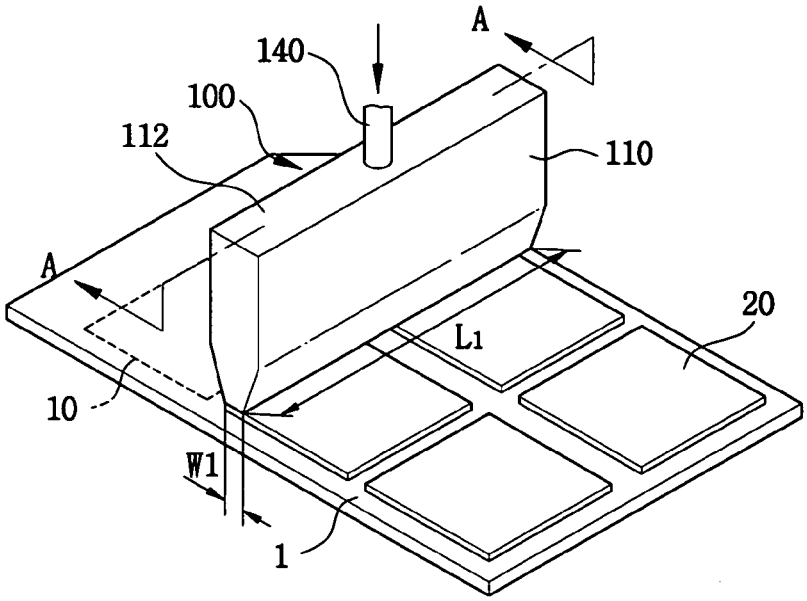
FIG. 2A is a perspective view showing a discharging unit for discharging a photosensitive material according to a first exemplary embodiment of the present invention.
Figure 2B:
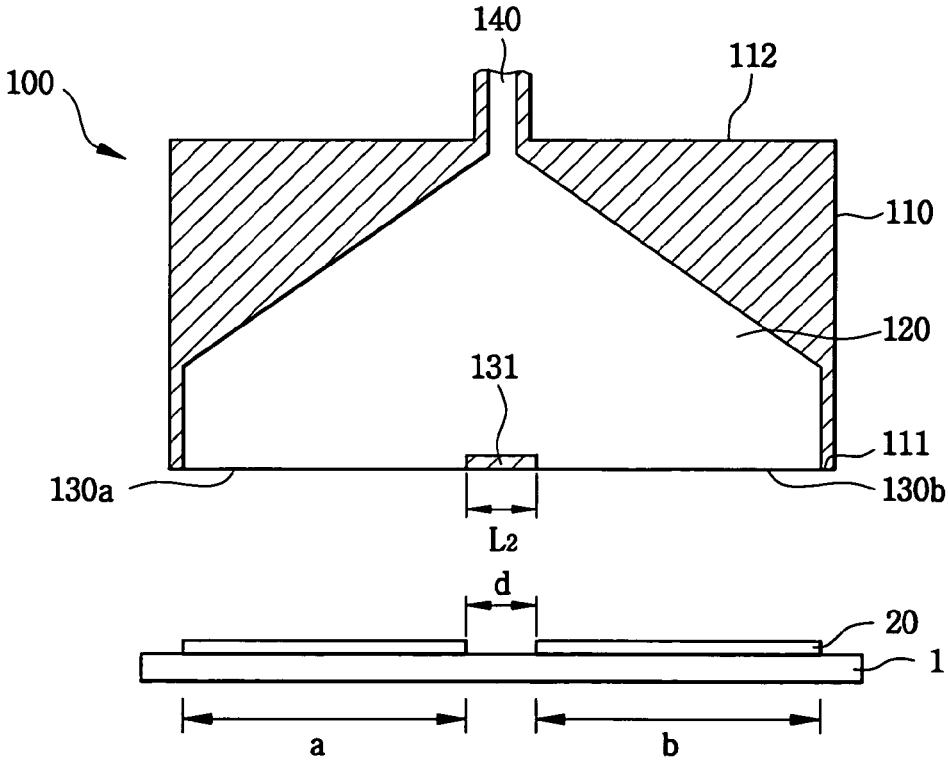
FIG. 2B is a cross-sectional view taken along the line A-A of FIG. 2A.

FIG. 2A is a perspective view showing a discharging unit for discharging a photosensitive material according to a first exemplary embodiment of the present invention. FIG. 2B is a cross-sectional view taken along the line A-A of FIG. 2A.

Referring to FIGS. 2A and 2B, a discharging unit 100 for discharging a photosensitive material includes a body 110 having a first face 111 facing a substrate 1 on which the photosensitive material is coated, an inlet portion 140 through which the photosensitive material is provided, and an outlet portion 130 through which the photosensitive material is discharged.

The body 110 includes a containing space 120 for containing the photosensitive material, a first face 111 facing the substrate 1, and a second face 112 opposite to the first face 111. The containing space 120 is formed inside the body 110 with a predetermined volume, and connected with an inlet portion 140 and an outlet portion 130. As an exemplary embodiment, the first face 111 is a base face of the body 110, and the second face 112 is a top face of the body 110.

For example, the inlet portion 140 is disposed on the second face 112, and is connected to the containing space 120. Therefore, the photosensitive material is provided into the containing space 120 through the inlet portion 140. The outlet portion 130 is disposed on the first face 111, and is connected to the containing space 120. As an exemplary embodiment, the outlet portion has an opening portion shaped into a slit having a length L1 much longer than a width W1 thereof, so that the photosensitive material is directly discharged onto the unit substrate 20 from the containing space 120.

The discharging unit 100 further includes an outlet divider 131 for controlling a stream direction of the photosensitive material, so that the photosensitive material is only discharged toward the unit substrate 20. As an exemplary embodiment, the outlet divider 131 is disposed inside the outlet portion 130, and obstructs the flow of the photosensitive material through the outlet portion 130. Therefore, the stream of the photosensitive material is divided by using the out divider 131, and the photosensitive material can be discharged only onto the unit substrate 20. For instance, the stream of the photosensitive material is divided into two sub-streams of the photosensitive material by one outlet divider 131. That is, the stream of the photosensitive material can be controlled to have a desiring direction by using the outlet divider 131. The outlet divider 131 may be formed as a portion of the body 110, or may be installed to the body 110 as an additional member. As an exemplary embodiment, a length L2 of the outlet divider 131 is identical to an interval d between the unit substrates 10 and 20, and a width of the outlet divider 131 is identical to a width W1 of the outlet portion 130. Therefore, the outlet portion 130 is divided into a first outlet 130*a* and a second outlet 130*b* by the outlet divider 131. The length of the first outlet 130*a* is identical to the width 'a' of a first unit substrate 10, and the length of the second outlet 130*b* is identical to the width 'b' of a second unit substrate 20.

According to the first embodiment of the discharging unit, the photosensitive material is only discharged through the first and second outlets 130*a* and 130*b*. The first and second outlets 130*a* and 130*b* cannot be discharged through an area corresponding to the outlet divider 131. Therefore, the discharging unit can prevent the photosensitive material from discharging onto an area of the mother substrate 1 corresponding to an intervals d between the unit substrates 10 and 20. Consequently, the photosensitive material disposed between the unit substrates 10 and 20 needs not to be removed after the photosensitive material is coated on the mother substrate 1.

While the first embodiment of the discharging unit includes one outlet divider, the discharging unit may have a plurality of outlet dividers in view of a number of the unit substrate aligned in a single line on the mother substrate, as would be known to any one of the ordinary skill in the art. That is, the number of the outlet divider is dependent on the number of the unit substrate aligning in the longitudinal direction of the outlet portion. As an exemplary embodiment, the number of the outlet divider is identical to the number of the unit substrate aligning in the longitudinal direction of the outlet portion.

Figure 3:
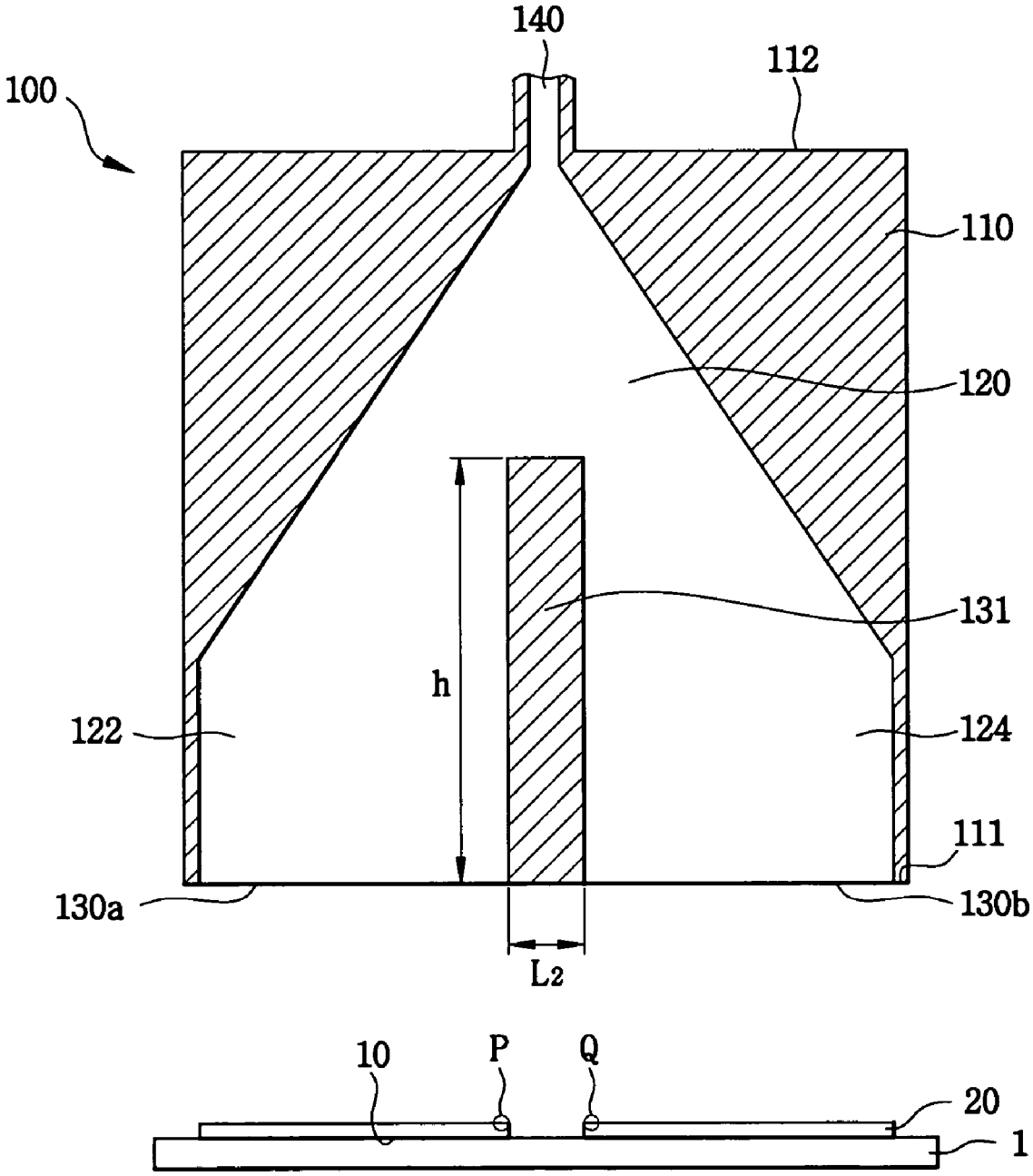
FIG. 3 is a cross sectional view showing a first modified embodiment of the discharging unit in FIG. 2B.

FIG. 3 is a cross sectional view showing a first modified embodiment of the discharging unit in FIG. 2B. The first modified discharging unit shown in FIG. 3 has the same structure as the first embodiment of the discharging unit has as shown in FIG. 2B, except the shape of the outlet divider. Therefore, in FIG. 3, the same reference numerals denote the same elements in FIG. 2B, and thus the detailed descriptions of the same elements will be omitted.

Referring to FIG. 3, the outlet divider 131 is protruded from the first face 111 toward the second face 112 inside the containing space 120 with a predetermined height h from the first face 111, so that the outlet divider 131 is formed into a column shape. Therefore, the containing space 120 neighboring the outlet portion 130 is divided into a first split containing space 122 corresponding to a first outlet 130*a* and a second split containing space 124 corresponding to a second outlet 130*b*. The column-shaped outlet divider improves the flow of the photosensitive material to be much steadier compared to the outlet divider of the first embodiment, so that the photosensitive material is more stably coated on side end portions P and Q of the unit substrates 10 and 20 adjacent to the outlet divider 131. Therefore, the coating uniformity of the unit substrate can be improved due to the column-shaped outlet divider 131.

Figure 4:
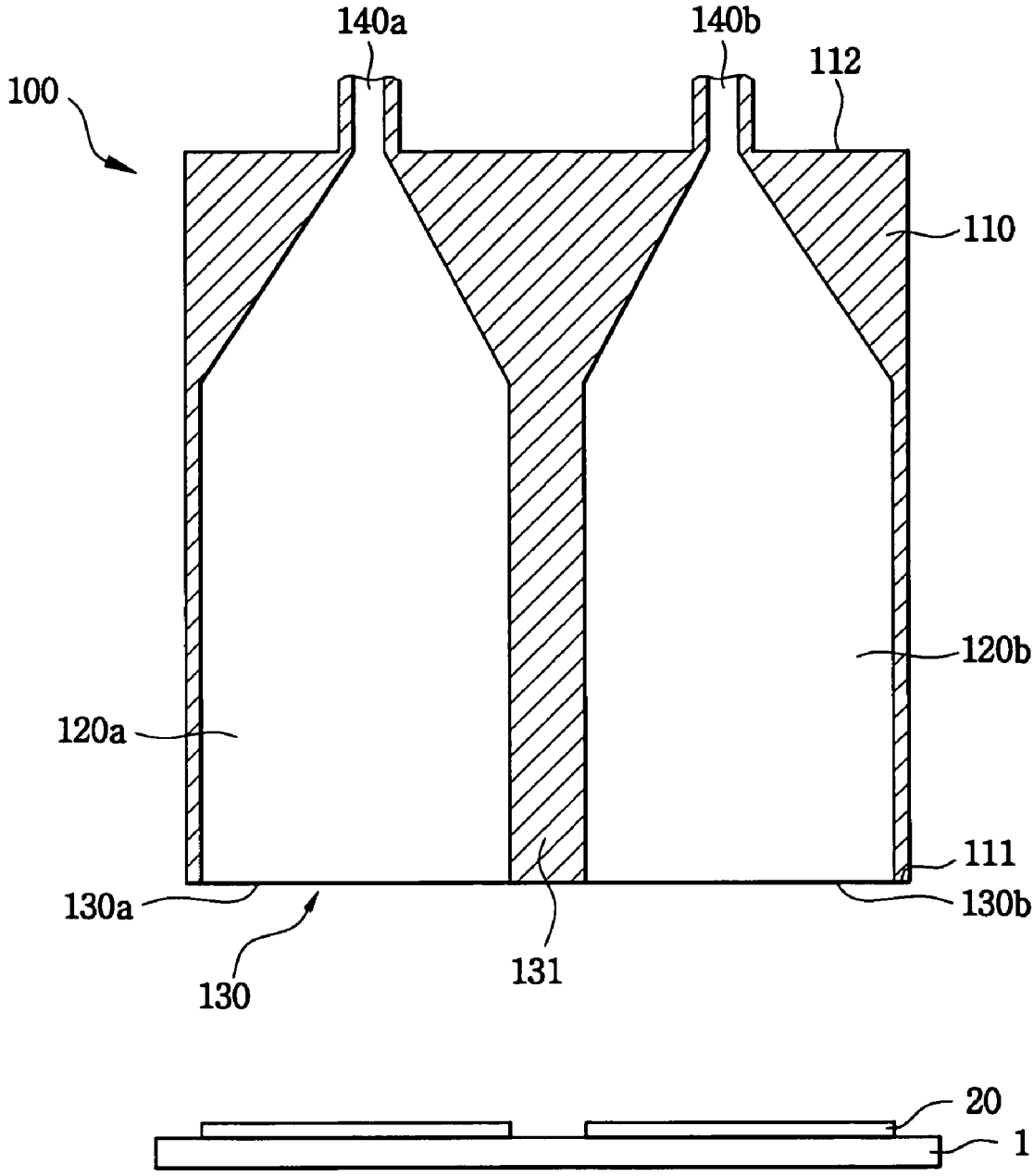
FIG. 4 is a cross sectional view showing a second modified embodiment of the discharging unit in FIG. 2B.

FIG. 4 is a cross sectional view showing a second modified embodiment of the discharging unit in FIG. 2B. The second modified discharging unit shown in FIG. 4 has the same structure as the first embodiment of the discharging unit has as shown in FIG. 2B, except that the discharging unit has a plurality of independent containing spaces and has a plurality of inlet portions through which the photosensitive material is individually provided to each of the containing spaces, respectively. Therefore, in FIG. 4, the same reference numerals denote the same elements in FIG. 2B, and thus the detailed descriptions of the same elements will be omitted.

Referring to FIG. 4, the body 100 includes a first and second containing spaces 120*a* and 120*b* for individually containing the photosensitive materials. The outlet divider 131 is extended to the second face 120*b*, thereby separating not only the containing space, but also the outlet portion 130. The first and second inlets 140*a* and 140*b* are individually installed on the second face 112, and connected to the first and second containing spaces 120*a* and 120*b*, respectively. Therefore, the photosensitive material is individually provided into the first and second containing spaces 120*a* and 120*b*.

As an exemplary embodiment, the length L2 of the outlet divider 131 is identical to the interval 'd' of the unit substrates, and the lengths of the first and second outlets 130*a* and 130*b* are also identical to the widths a and b of the first and second unit substrates 10 and 20.

As a result, the photosensitive material is only discharged onto the surface of the unit substrate, and may be prevented from discharging onto an area of the mother substrate 1 corresponding to an interval d between the unit substrates 10 and 20. In addition, the above-mentioned modified discharging unit can selectively discharge the photosensitive material on the unit substrate since the photosensitive material is individually provided through the independent inlet portions, so that the photosensitive layer can be selectively coated on the unit substrate. Accordingly, when a particular unit substrate is known to be defective (hereinafter, referred to as a defective substrate), the photosensitive material is not provided to the containing space, which is connected to the outlet portion for discharging the photosensitive material onto the defective substrate, any longer, so that the photosensitive material is not coated on the defective substrate, thereby reducing the photosensitive material consumption.

Embodiment 2

Figure 5A:
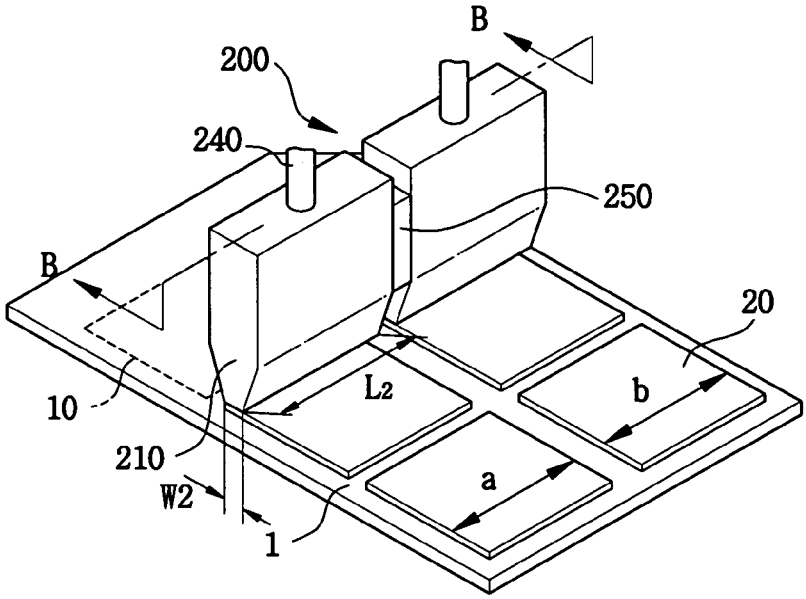
FIG. 5A is a perspective view showing a discharging unit according to a second exemplary embodiment of the present invention.
Figure 5B:
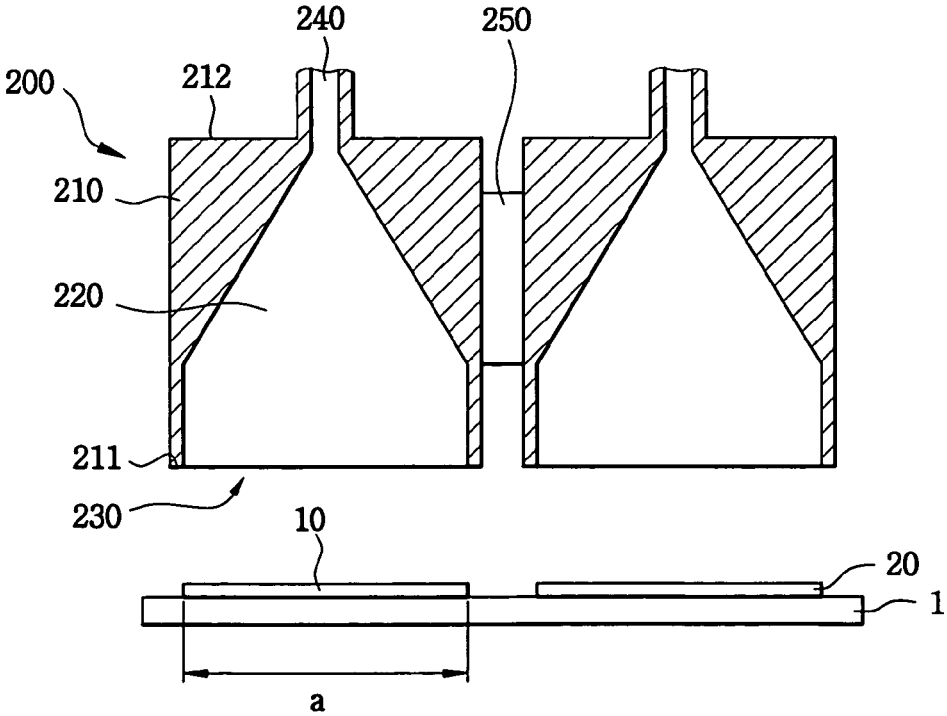
FIG. 5B is a cross-sectional view taken along the line B-B of FIG. 5A.

FIG. 5A is a perspective view showing a discharging unit according to a second exemplary embodiment of the present invention. FIG. 5B is a cross-sectional view taken along the line B-B of FIG. 5A.

Referring to FIGS. 5A to 5B, a discharging unit 200 for discharging a photosensitive material includes a plurality of bodies 210 having a first face 211 facing a substrate 1 on which the photosensitive material is coated, an inlet portion 240 through which the photosensitive material is provided, an outlet portion 230 through which the photosensitive material is discharged, and at least a spacer block 250 for combining the bodies with each other.

A plurality of unit substrates 10 and 20 for manufacturing an LCD panel is positioned on the mother substrate 1 that is spaced apart from each other by a predetermined distance d.

Each of the bodies 210 includes a containing space 220 for containing the photosensitive material, a first face 211 facing the mother substrate 1, and a second face 212 opposite to the first face 211. The containing space 220 is formed inside the body 210 with a predetermined volume, and connected with an inlet portion 240 and an outlet portion 230. As an exemplary embodiment, the first face 211 is a base face of the body 210, and the second face 212 is a top face of the body 210.

For example, the inlet portion 240 is disposed on the second face 212, and is connected to the containing space 220. Therefore, the photosensitive material is provided into the containing space 220 through the inlet portion 240. The outlet portion 230 is disposed on the first face 211, and is connected to the containing space 220. As an exemplary embodiment, the outlet portion 230 has an opening portion shaped into a slit having a length L2 much longer than a width W2 thereof, so that the photosensitive material is directly discharged onto each of the unit substrates 10 and 20 from the containing space 220.

The plurality of the bodies 210, which has the inlet portion 240 and the outlet portion 230 respectively, is arranged such that each of the bodies 210 corresponds to the unit substrates 10 and 20 by one to one along the longitudinal direction of the body 210, and the spacer block 250 combines the plurality of the bodies 210 in one body. Therefore, the plurality of the bodies 210 integrally moves and discharges the photosensitive material onto the unit substrate. The length of the outlet portion 230 is formed to be identical to the width the corresponding unit substrate, so that the photosensitive material can only be discharged onto the unit substrate. Thus, the photosensitive material may be prevented from discharging on the region of the mother substrate corresponding to the interval 'd' between the unit substrates 10 and 20.

The discharging unit according to the second embodiment exemplary discloses unit substrates aligning in two rows on the mother substrate. However, when the unit substrates are arranged in three or more rows on the mother substrate, the body corresponding to an additional unit substrate row can be easily added by using an additional spacer block 250 without replacement of the operating discharging unit. Therefore, the discharging unit of the second embodiment of the invention can advantageously be flexible to the modification of the mother substrate. In addition, the photosensitive material is individually discharged, so that the photosensitive material can be selectively coated on the unit substrate if necessary. That is, when a defective substrate is detected, the photosensitive material is not provided to the containing space, which is connected to the outlet portion for discharging the photosensitive material onto the defective substrate, any longer, and as a result, the photosensitive material is not coated on the defective substrate, thereby reducing the photosensitive material consumption.

Exemplary Embodiment on the Coater Including the Discharging Unit

Figure 6:
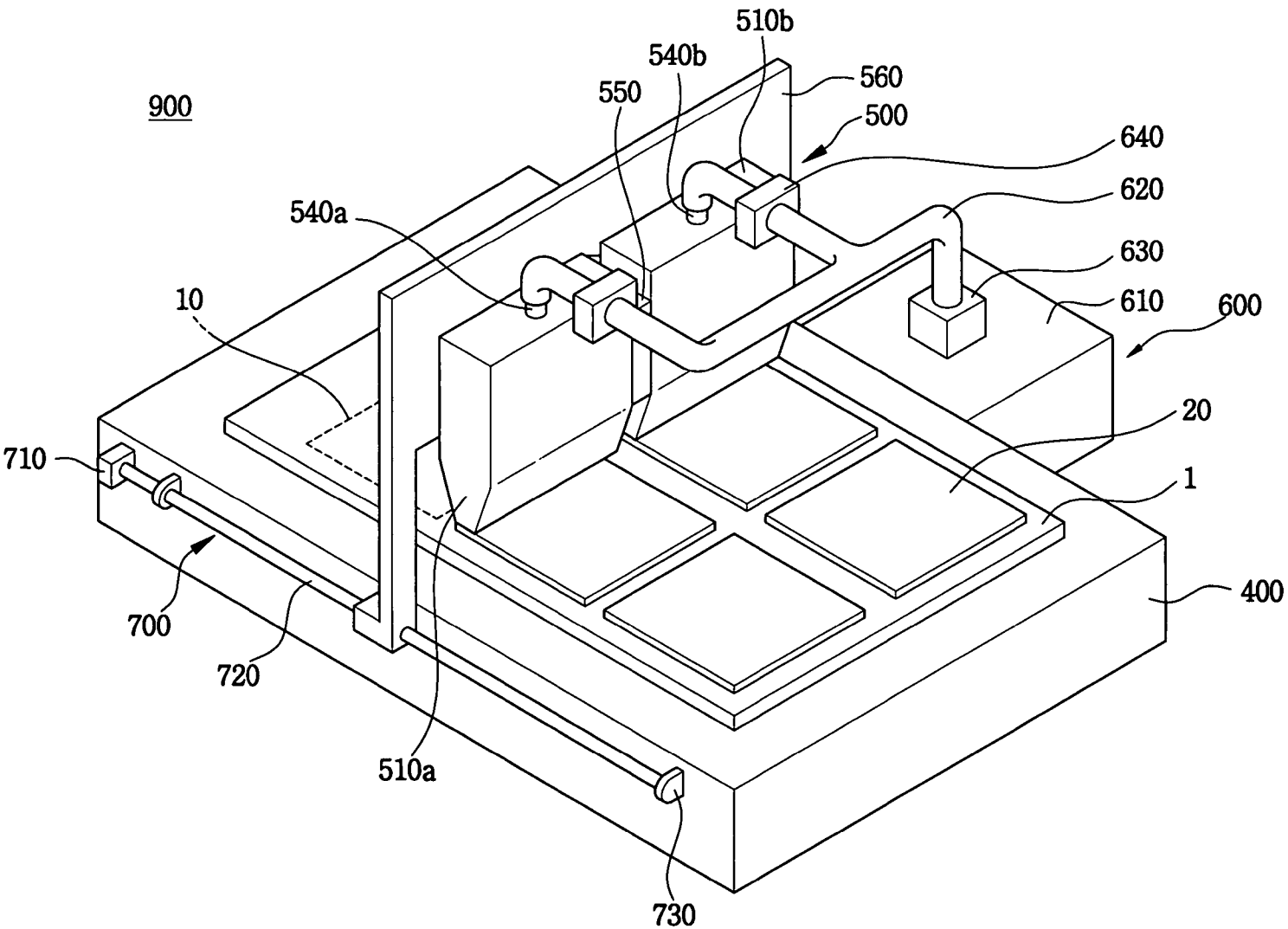
FIG. 6 is a perspective view showing a coater according to a first embodiment of the present invention.
Figure 7:
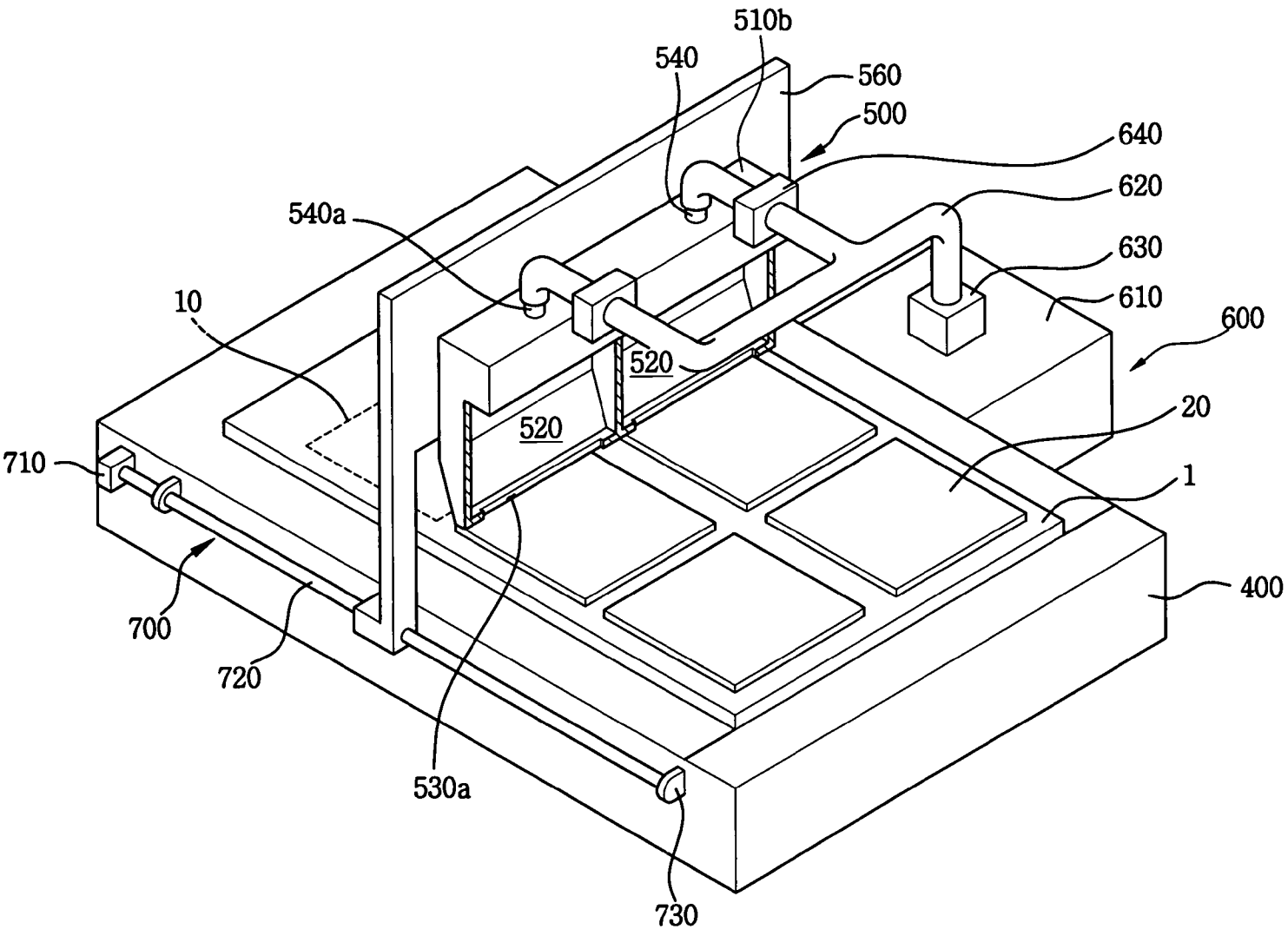
FIG. 7 is a perspective view showing a coater according to a second embodiment of the present invention.

FIG. 6 is a perspective view showing a coater according to a first embodiment of the present invention, and FIG. 7 is a perspective view showing a coater according to a second embodiment of the present invention. The first embodiment of the coater shown in FIG. 6 includes the second embodiment of the discharging unit shown in FIGS. 5A and 5B, and the second embodiment of the coater shown in FIG. 7 includes the second modification of the first embodiment of the discharging unit shown in FIG. 4.

Referring to FIGS. 6 and 7, the coater for coating the photosensitive layer on a mother substrate includes a support 400 for supporting the mother substrate 1, a discharging unit 500 for discharging the photosensitive material onto the substrate 1, a supplying unit 600 for supplying the photosensitive material to the discharging unit 500, and a transferring unit 700 for transferring the discharging unit 500 relative to the support 400.

The mother substrate 1 is disposed on an upper surface of the support 400, and includes a plurality of unit substrates 10 and 20 to be manufactured into an LCD panel.

The discharging unit 500 has the same structure of the second embodiment of the discharging unit shown in FIGS. 5A and 5B, or the same structure of the second modification of the first embodiment of the discharging unit shown in FIG. 4. Therefore, in FIGS. 6 and 7, the same reference numerals denote the same elements in FIGS. 5A, 5B, and 4, and thus the detailed descriptions of the same elements will be omitted. Another exemplary embodiment of the coater may also include the first embodiment of the discharging unit shown in FIGS. 2A and 2B, or include the first modification of the first embodiment of the discharging unit shown in FIG. 3, as would be known to a person having an ordinary skill in the art.

The discharging unit 500 is secured to a securing bracket 560. The securing bracket 560 is movably coupled with the transferring unit 700 to cross the support 400, and positioned having a space of a predetermined distance from the upper surface of the support 400. Both side end portions of the securing bracket 560 respectively face to both widthwise side surfaces of the support 400.

The transferring unit 600 includes a reservoir 610 for storing the photosensitive material, supplying pipes 620 connected to the inlet portion of the discharging unit 500, a pump 630 for pumping out the photosensitive material, and a controller 640 for controlling the photosensitive material flux supplied to the containing space of the discharging unit 500. The photosensitive material is at first stored in the reservoir 610, and then supplied to the discharging unit 500 through the supplying pipe 620. Both of the bodies 510*a* and 510*b* are connected to the reservoir 610 by using the supplying pipe 620 having two branches corresponding to the bodies 510*a* and 510*b*, respectively. A pipe end of the supplying pipe 620 is connected to the pump 630, and two branch ends of the supplying pipe branches are connected to inlet portions 540*a* and 540*b* of the bodies 510*a* and 510*b*, respectively. The pump 630 is secured to the reservoir 610, and pressurizes the photosensitive material in the reservoir 610, thereby facilitating the supply of the photosensitive material to the discharging unit 500. The controller 640 installed on the supplying pipe 620 elaborately controls an opening area of the supplying pipe 620, thereby controlling the photosensitive material flux supplied to the containing space of the discharging unit 500.

The transferring unit 700 includes a motor 710, a guide rail 720, and a fixing part 730. As an exemplary embodiment, a pair of the guide rail 720 is disposed on both side surfaces of the support 400 along a longitudinal direction thereof. An end of the guide rail 720 is coupled to the motor 710, and the other end of the guide rail 720 is connected to the fixing part 730. The motor 710 rotates the guide rail 720, and the securing bracket 560 is coupled to the guide rail 720, thereby moving along the guide rail 720.

The coater that includes the discharging unit according to an exemplary embodiment, operates with reference to FIGS. 6 and 7 as follows:

At first, the mother substrate 1 on which preceding processes are performed is positioned on the support 400. Then, the supplying unit 600 is operated such that the photosensitive material in the reservoir 610 is supplied to each of the bodies 510*a* and 510*b*, respectively, through the supplying pipe 620 by using the pump 630.

The motor 710 rotates at a predetermined angular speed, and the securing bracket 560 on which the discharging unit 500 is secured moves along the guide rail 720. At that time, the photosensitive material is discharged through the outlet portions 540*a* and 540*b* of each of bodies 510*a* and 510*b*, respectively, onto the corresponding unit substrate 20. Accordingly, the photosensitive material can be discharged only onto the unit substrate 20.

Exemplary Embodiment on an Apparatus for Coating a Photosensitive Layer

Figure 8:
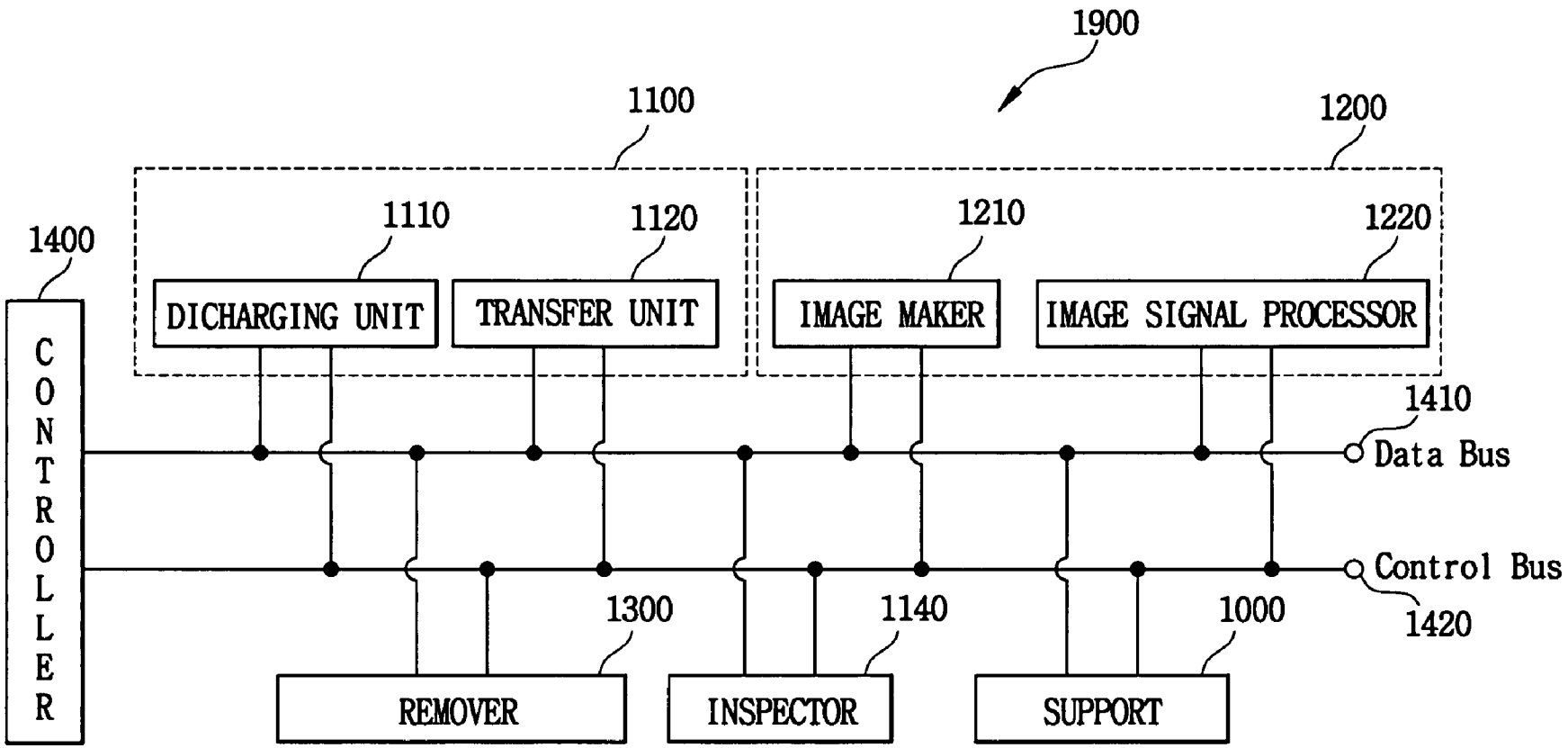
FIG. 8 is a block diagram showing an apparatus for coating a photosensitive layer on a substrate according to an embodiment of the present invention.
Figure 9:
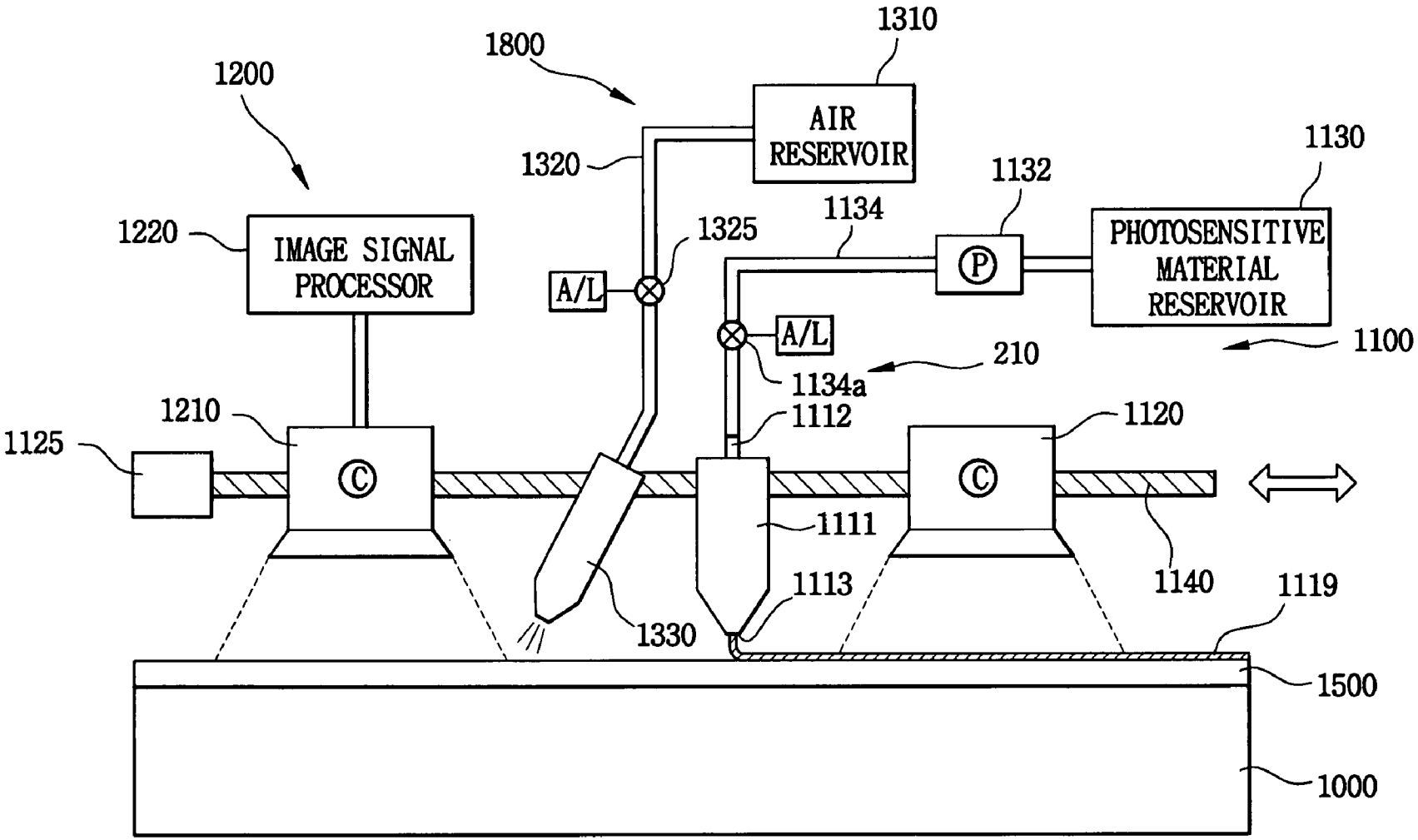
FIG. 9 is a schematic view schematically showing a structure of an apparatus for coating a photosensitive layer on a substrate according to an exemplary embodiment of the present invention.

FIG. 8 is a block diagram showing an apparatus for coating a photosensitive layer on a substrate according to an embodiment of the present invention, and FIG. 9 is a schematic view schematically showing a structure of an apparatus for coating a photosensitive layer on a substrate according to an exemplary embodiment of the present invention.

Referring to FIGS. 8 and 9, a coating apparatus 1900 according to an embodiment of the invention includes a support 1000 for supporting a mother substrate having a plurality of unit substrate 1500 on which the photosensitive material is coated, a coater 1100 for coating a photosensitive layer on the unit substrate 1500, a detector for detecting foreign matters on the unit substrate 1500, a remover 1300 for removing the foreign matters, and a controller 1400 for controlling the coater 1100, the detector 1200 and the remover 1300.

The support 1000 is formed into a hexagonal board having a good flatness, thus supports and fixes the mother substrate including the plurality of unit substrates 1500. As an exemplary embodiment, the support 1000 may include a vacuum generator (not shown) for fixing the mother substrate by using vacuum. The controller 1400 also controls the vacuum generator.

The coater 1100 is installed above the support 1000. As an exemplary embodiment, the coater 1100 includes a discharging unit 1110 for discharging the photosensitive material, a transfer unit 1120 for transferring the discharging unit along a surface of the mother substrate, and a reservoir 1130 for storing the photosensitive material.

The discharging unit 1110 includes a body 1111 having a hexagonal shape, and a containing space for containing the photosensitive material is formed inside the body 1111. The body 1111 includes an outlet portion 1113 through which the photosensitive material is discharged onto the unit substrate 1500, and an inlet portion 1112 through which the photosensitive material is supplied into the containing space. As an exemplary embodiment, the discharging unit 1110 may be one of the embodiments as shown in FIGS. 2A to 5B. Accordingly, when the mother substrate includes a plurality of unit substrates for manufacturing an LCD panel, the photosensitive material can be only discharged onto the unit substrate. In addition, the photosensitive material can be selectively discharged according to the substrate state, so that the photosensitive material can be prevented from being coated on the defective substrate.

The reservoir 1130 stores a great quantity of the photosensitive material, and further includes a pump 1132 and a first supplying pipe 1134 so as to supply the photosensitive material to the discharging unit 1110. The pump 1132 applies pressure into the inside of the reservoir 1130, and forces the photosensitive material to move into the containing space of the body 1114. The first supplying pipe 1134 is connected to the pump 1132 and the inlet portion 1112 of the discharging unit 1110, so that the photosensitive material is forcibly supplied to the containing space of the body 1111 through the inlet portion 1112. As an exemplary embodiment, a first solenoid valve 1134*a* is installed on the first supplying pipe 1134 so as to close or open the first supplying pipe 1134. The first solenoid valve 1134*a* is operated according to the controller signal.

The photosensitive material in the containing space is discharged through the outlet portion 1113 by, for example, gravitational force, thus is coated on the surface of the unit substrate 1500 to thereby form a photosensitive layer 1119 on the surface. As described in the above, the photosensitive material is discharged only onto the unit substrate of the mother substrate, and is not coated on the gap portion between the unit substrates on the mother substrate.

The transfer unit 1120 moves the discharging unit 1110 horizontally along a surface of the support 1000. The speed of the transfer unit 1120 is so constant that the photosensitive layer 1119 can be coated with uniform thickness. As an exemplary embodiment, the transfer unit 1120 further includes an interrupter 1125 to stop the transfer unit 1120 when the transfer unit 1120 is in danger of colliding with foreign matters on the unit substrate 1500. The foreign matters on the unit substrate 1500 cause a fatal process failure during subsequent process, and particularly, foreign matters of high hardness cause fracture of the discharging unit 1100 or unit substrate 1500. Furthermore, the foreign matters may cause a fatal scratch on the unit substrate 1500 in case that the foreign matters are adhered to the discharging unit 1110 and dragged along the surface of the unit substrate 1500. Therefore, a detector 1200 is installed in front of the coater 1100.

The detector 1200 may detect the foreign matters through various manners. For example, the detector is located at several hundred micrometers distance from the unit substrate 1500, and detects the foreign matters using the vibration caused when the detector 1200 makes contact with the foreign matters. However, the contact type detector may cause a fatal scratch on the unit substrate when the foreign matters are adhered to the detector 1200 and dragged on the surface of the unit substrate. In addition, the contact type detector has disadvantages in that the foreign matters having a size less than the gap between the unit substrate 1500 and the detector 1200 cannot be detected, and even a tiny break of the evenness of the mother substrate causes a substrate fracture or a scratch on the substrate. The contact type detector is rarely applied during the coating process of the photosensitive material.

The detector 1200 of the present invention detects the foreign matters through a non-contact method. For example, the detector 1200 visually detects the foreign matters using an image sensor 1210 and image signal processor 1220. As an exemplary embodiment, the image sensor 1210 is a charge-coupled device. The image signal processor 1220 processes image signals generated from the image sensor 1210, for thereby generating a first signal or a second signal. The first signal is generated when the image sensor 1210 senses the foreign matters, and the second signal is generated when the image sensor 1210 does not sense the foreign matters. The first or second signal is applied to the controller 1400 through data bus 1410.

The remover 1300 also operates according to the controller signal, and removes the foreign matters detected by the detector 1200. The remover 1300 of the present invention may remove the foreign matters using an injected gas with high speed.

As an exemplary embodiment, the remover 1300 includes air reservoir 1310 for reserving air, a second supplying pipe 1320 for supplying the air, and an air knife 1330 for injecting the air. An end of the second supplying pipe 1320 is connected to the air reservoir 1310, and the other end of the second supplying pipe 1320 is connected to the air knife 1330. A second solenoid valve 1325 is installed to the second supplying pipe 1320 so as to close or open the second supplying pipe 1320. The second solenoid valve 1325 is also operated according to the controller signal.

As an exemplary embodiment, the transfer unit 1120 may further include an inspector 1140 for inspecting a surface of the photosensitive layer 1119 and detecting a coating defect of the photosensitive layer 1119. For example, the charge-coupled device may be used as the inspector 1140 of the invention. The controller 1400 also processes the image generated in the inspector 1440.

The controller 1400 controls the support 1000, the coater 1100, the detector 1200, and the remover 1300. Data signals generated from the support 1000, the coater 1100, the detector 1200 and the remover 1300 are inputted or outputted to/from the controller 1400 through the data bus 1410. Control signals generated from the support 1000, the coater 1100, the detector 1200 and the remover 1300 are inputted or outputted to/from the controller 1400 through the control bus 1420.

Figure 10:
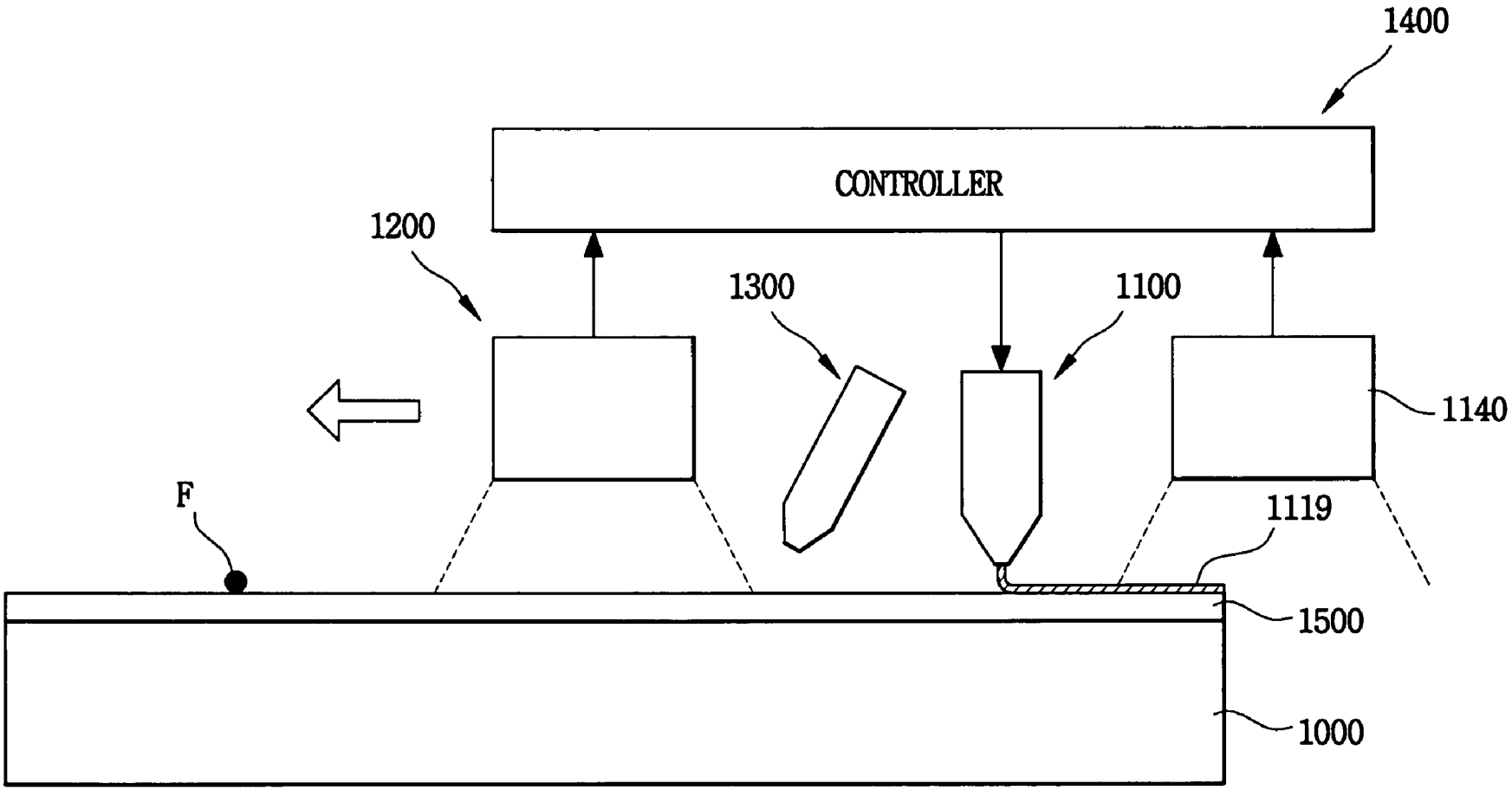
FIG. 10 is a view showing an initial operation of the apparatus for coating a photosensitive layer on a substrate shown in FIG. 9.

Hereinafter, the operation of the coating apparatus will be described in the following with reference to FIGS. 9 and 10. FIG. 10 is a view showing an initial operation of the apparatus for coating a substrate shown in FIG. 9.

Referring to FIGS. 9 and 10, a mother substrate including a plurality of unit substrates 1500 on which the photosensitive material is coated is mounted on the support 1000. Then, the image sensor 1210 of the detector 1200 takes a picture of a surface of the unit substrate 1500 on which the photosensitive material is not coated. The image sensor 1210 transmits signals of the image of the substrate surface to the image signal processor 1220. The image signal processor 1220 processes the image signals, and determines whether the foreign matters are located on the unit substrate 1500. When the foreign matters are located on the unit substrate 1500, the image signal processor 1220 generates the first signal to be transmitted to the controller 1400. In contrast, when the foreign matters are not located on the unit substrate 1500, the image signal processor 1220 generates the second signal to be transmitted to the controller 1400. Therefore, at the initial operation state of the coating apparatus shown in FIG. 10, the image signal processor 1220 generates the second signal.

When the second signal is applied to the controller 1400, the controller 1400 applies a control signal to the first solenoid valve **1134*a*, thus the first solenoid valve 1134*a* is opened. Finally, the photosensitive material is discharged from the discharging unit 1110 onto the unit substrate 1500**.

Figure 11:
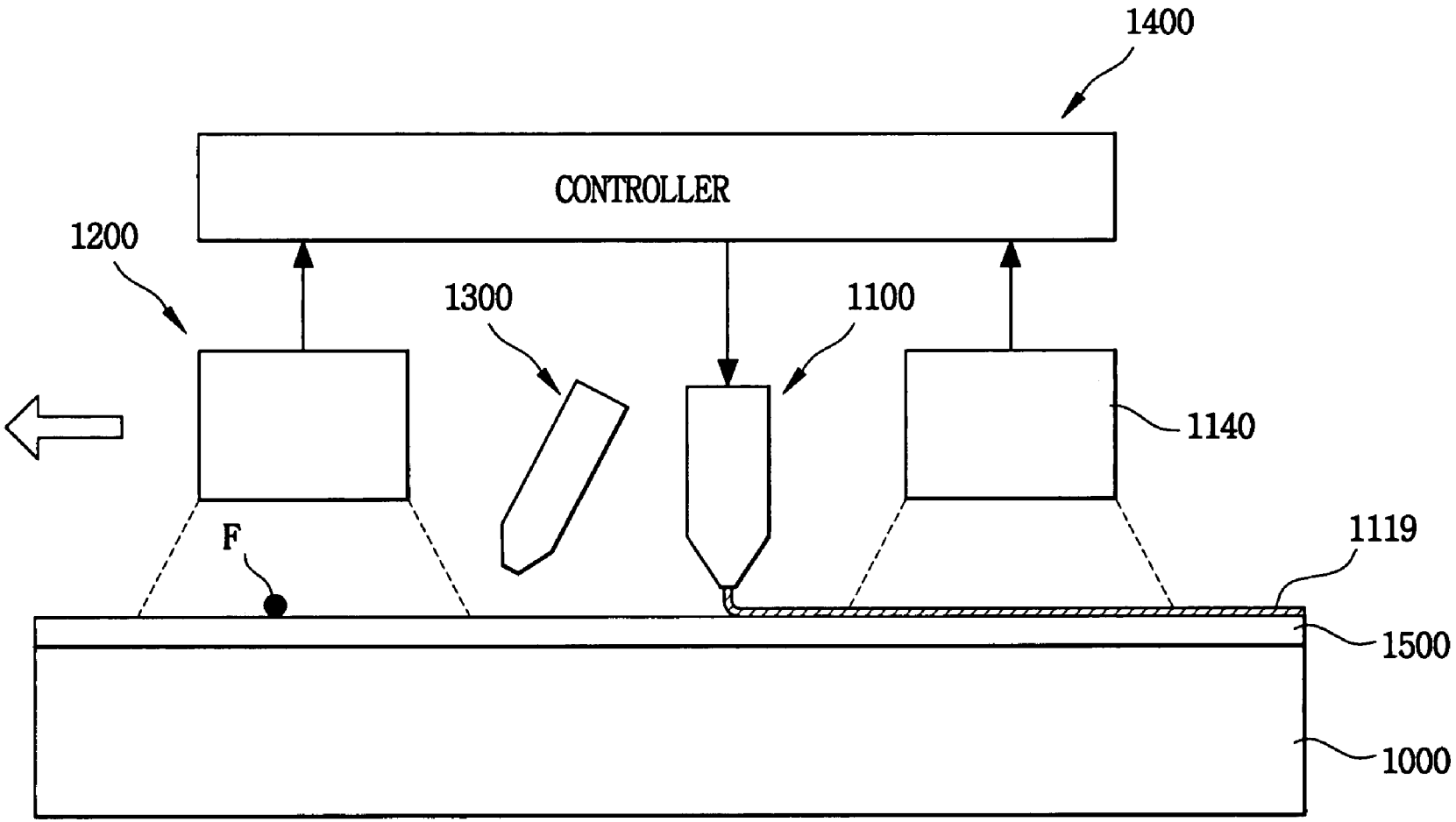
FIG. 11 is a view showing a removal of the foreign matters in the apparatus for coating a photosensitive layer on a substrate shown in FIG. 9.

FIG. 11 is a view showing a removal process of the foreign matters in the apparatus for coating a photosensitive layer on a substrate shown in FIG. 9.

Referring to FIGS. 9 and 11, the image sensor 1210 takes a picture of a surface of the unit substrate 1500 on which the photosensitive material is being coated. The image sensor 1210 transmits image signals of the substrate surface image to the image signal processor 1220. When the foreign matters F are located on the unit substrate 1500, the image signal processor 1220 generates a first signal. When the second signal is applied to the controller 1400, the controller 1400 applies a control signal to the second solenoid valve **1134*a*, thus the second solenoid valve 1325 is opened. Finally, the air is injected from the air knife 1330** toward the foreign matters F, thereby removing the foreign matters F.

Figure 12:
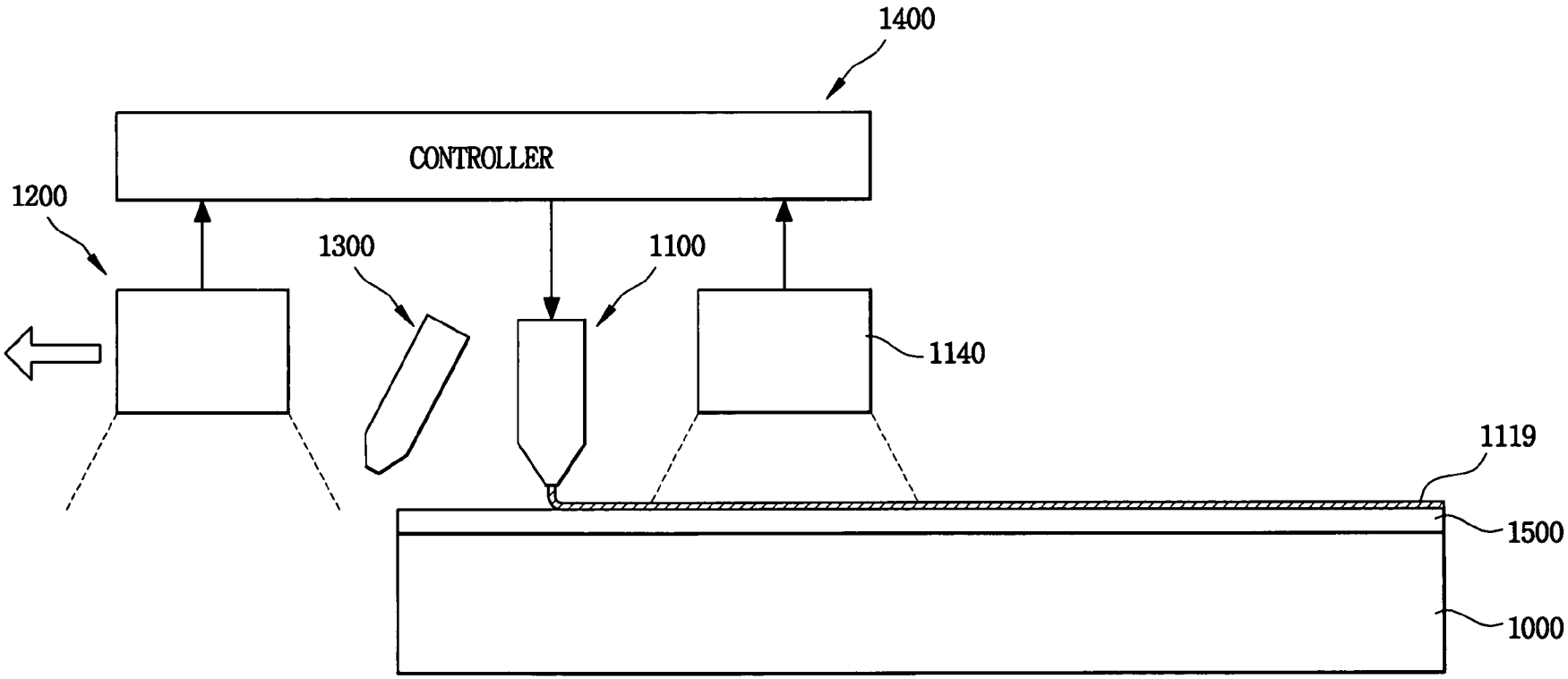
FIG. 12 is a view showing a coating of the photosensitive material in the apparatus for coating a photosensitive layer on a substrate shown in FIG. 9.

FIG. 12 is a view showing a coating of the photosensitive material in the apparatus for coating a photosensitive layer on a substrate shown in FIG. 9.

Referring to FIGS. 9 and 12, the controller 1400 controls the discharging unit to continuously discharge the photosensitive material onto the unit substrate without the foreign matters F, so that the photosensitive layer 1119 is formed on the whole substrate surface with uniform thickness.

Figure 13:
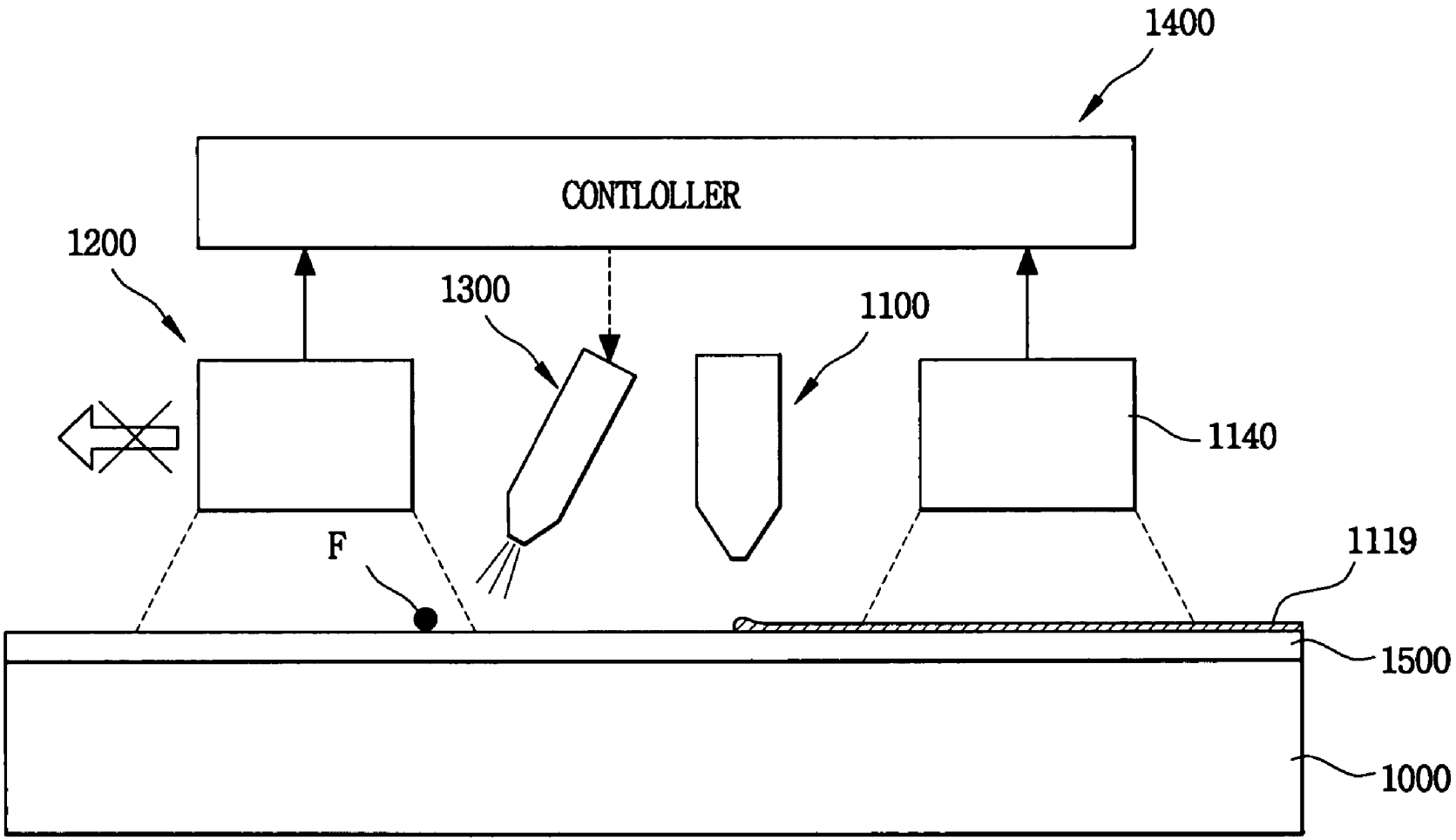
FIG. 13 is a view showing an interruption of a transfer unit in the apparatus for coating a photosensitive layer on a substrate shown in FIG. 9 due to foreign matters.

FIG. 13 is a view showing an interruption of a transfer unit in the apparatus for coating a photosensitive layer on a substrate shown in FIG. 9 due to foreign matters.

Referring to FIGS. 9 and 13, the image sensor 1210 takes a picture of a surface of the unit substrate 1500 on which the photosensitive material is being coated. The image sensor 1210 transmits image signals of the substrate surface image to the image signal processor 1220. When the foreign matters F are located on the unit substrate 1500, the controller 1400 drives the remover 1300 to remove the foreign matters F. When the foreign matters F are not removed by the remover 1300, the controller 1400 transmits the control signal to the interrupter 1125, thus the transfer unit 1120 is compelled to stop. At the same time, the controller 1400 transmits the control signal to the first solenoid valve 1134*a*, so that first solenoid valve 1134*a* is closed and the photosensitive material is not supplied to the discharging unit 1110. Accordingly, the substrate fracture or the discharging unit fracture due to the foreign matters may be prevented. An operator of the remover 1300 manually removes the remaining foreign matters, which are not removed by the remover 1300. Once the foreign matters remaining on the unit substrate 1500 are completely removed by the operators, the coating process is continuously performed.

According to the coating apparatus of the invention, the foreign matters are detected and removed from the unit substrate before the coating process is performed, so that the fracture or scratch of the substrate is prevented. In addition, when the foreign matters are not removed from the surface of the substrate, the coating process is immediately interrupted, so that the photosensitive material is prevented from wasting.

Although the exemplary embodiments of the present invention have been described, it is understood that the present invention should not be limited to these preferred embodiments but various changes and modifications can be made by one skilled in the art within the spirit and scope of the present invention as hereinafter claimed.

What is claimed is:

1. An apparatus for coating a photosensitive layer on a substrate, comprising:

a support supporting a substrate having a plurality of unit substrates on which a photosensitive material is coated;

a coater including a discharging unit for discharging the photosensitive material onto the unit substrate and a transfer unit for moving the discharging unit along a surface of the substrate, the coater coating the photosensitive layer on the substrate by the unit substrate;

a detector disposed in front of the coater, the detector detecting foreign matters on the surface of the substrate;

a remover removing the foreign matters detected by the detector; and a controller controlling the coater, the detector, and the remover.

2. The apparatus for coating a photosensitive layer of claim 1, wherein the detector includes an image sensor and a signal generator, the image sensor photographing the surface of the substrate and creating a surface image of the surface of the substrate, and the signal generator processing the surface image and generating a signal for operating the remover in case the foreign matters are found on the surface of the substrate.

3. The apparatus for coating a photosensitive layer of claim 2, wherein the image sensor includes a camera having a charge-coupled device (CCD).

4. The apparatus for coating a photosensitive layer of claim 1, wherein the remover includes an air knife, the air knife injecting a gaseous material to the foreign matters, for thereby removing the foreign matters.

5. The apparatus for coating a photosensitive layer of claim 1, wherein the transfer unit includes an interrupter, the interrupter forcibly stopping the transfer unit for preventing the discharging unit from being damaged by residual foreign matters remaining on the substrate after a removing process by the remover.

6. The apparatus for coating a photosensitive layer of claim 1, further comprising an inspector disposed in rear of the discharging unit, the inspector inspecting a surface of the photosensitive layer coated on the substrate.

7. The apparatus for coating a photosensitive layer of claim 6, wherein the inspector includes an image sensor photographing the surface of the photosensitive layer and creating a surface image of the surface of the photosensitive layer.

8. An apparatus for coating a photosensitive layer on a substrate, comprising:

a support supporting a substrate having a plurality of unit substrates on which a photosensitive material is coated;

a coater including a discharging unit for discharging the photosensitive material onto the unit substrate and a transfer unit for moving the discharging unit along a surface of the substrate, the coater coating the photosensitive layer on the substrate by the unit substrate;

a detector disposed in front of the coater, the detector detecting foreign matters on the surface of the substrate, wherein the transfer unit includes an interrupter to stop the transfer unit after the detector detects a foreign matter; and a controller controlling the coater and the detector.

9. The apparatus for coating a photosensitive layer of claim 8, wherein the detector includes an image sensor photographing the surface of the substrate and creating a surface image of the surface of the substrate.

10. The apparatus for coating a photosensitive layer of claim 9, wherein the image sensor includes a camera having a charge-coupled device (COD).

11. The apparatus for coating a photosensitive layer of claim 8, wherein the interrupter forcibly stops the transfer unit for preventing the discharging unit from being damaged by foreign matters.

12. An apparatus for coating a photosensitive layer on a substrate, comprising:

a support supporting a substrate having a plurality of unit substrates on which a photosensitive material is coated;

a coater including a discharging unit for discharging the photosensitive material onto the unit substrate and a transfer unit for moving the discharging unit along a surface of the substrate, the coater coating the photosensitive layer on the substrate by the unit substrate;

a detector disposed in front of the coater, the detector detecting foreign matters on the surface of the substrate;

a controller controlling the coater and the detector; and an inspector disposed in rear of the discharging unit, the inspector inspecting a surface of the photosensitive layer coated on the substrate.

13. The apparatus for coating a photosensitive layer of claim 12, wherein the inspector includes an image sensor photographing the surface of the photosensitive layer and creating a surface image of the surface of the photosensitive layer.

* * * * *